United States Patent [19]

Nagai

[11] Patent Number: 4,969,765

[45] Date of Patent: Nov. 13, 1990

[54] MECHANICAL MARKING PEN

[75] Inventor: Masahiko Nagai, Tokyo, Japan

[73] Assignee: Ogawa Chemical Industries Ltd., Tokyo, Japan

[21] Appl. No.: 789,179

[22] Filed: Oct. 18, 1985

[30] Foreign Application Priority Data

Dec. 29, 1984 [JP] Japan ..... 59-201967

[51] Int. Cl.[5] ..... B43K 8/06; B43K 8/08

[52] U.S. Cl. ..... 401/199; 401/54

[58] Field of Search ..... 401/198, 199, 54

[56] References Cited

U.S. PATENT DOCUMENTS

| | | | |
|---|---|---|---|
| 3,355,239 | 11/1967 | Albrecht | 401/199 X |
| 3,402,008 | 9/1968 | Green | 401/199 |
| 3,479,122 | 11/1969 | Funahashi | 401/199 |
| 4,209,263 | 6/1980 | Droubay | 401/199 |
| 4,317,639 | 3/1982 | Kato | 401/199 |
| 4,357,117 | 11/1982 | Nagai | 401/199 |
| 4,408,921 | 10/1983 | Nagai | 401/199 |

FOREIGN PATENT DOCUMENTS

| | | | |
|---|---|---|---|
| 0042289 | 12/1981 | European Pat. Off. | 401/199 |
| 1250302 | 9/1967 | Fed. Rep. of Germany | 401/199 |
| 2905839 | 10/1979 | Fed. Rep. of Germany | 401/199 |
| 47-36529 | 12/1972 | Japan . | |
| 49-1031 | 1/1974 | Japan . | |
| 54-151438 | 10/1979 | Japan . | |
| 54-179248 | 12/1979 | Japan . | |
| 55-5241 | 1/1980 | Japan . | |
| 55-5242 | 1/1980 | Japan . | |
| 55-5268 | 1/1980 | Japan . | |
| 55-10789 | 1/1980 | Japan . | |
| 55-23778 | 2/1980 | Japan . | |
| 56-3684 | 1/1981 | Japan | 401/199 |
| 57-9579 | 1/1982 | Japan . | |
| 2052397 | 1/1981 | United Kingdom | 401/198 |
| 2148200 | 9/1983 | United Kingdom | 401/199 |

*Primary Examiner*—Steven A. Bratlie

[57] ABSTRACT

A mechanical marking pen is disclosed. The marking pen includes a cylinder and a holder element axially and movably engaged with one end of the cylinder. A pen point is removably attached to the cylinder and is slidably fitted concentrically in the holder element so as to project from the holder element to permit a length of projection to be adjusted. There is an ink reservoir contained in the cylinder for storing ink. An ink guide core is provided to connect the pen point and ink reservoir to allow the transfer of ink to the pen point. There is an element concentric with the pen point, for receiving and transferring writing pressure from the pen point. Finally, an element is mounted concentric with the pen point and is engaged with the receiving and transferring element. This element accepts writing pressure from the transferring means to prevent the ink guide core from bearing pressure from the pen point.

18 Claims, 15 Drawing Sheets

MECHANICAL MARKING PEN

BACKGROUND OF THE INVENTION

The parent invention relates to a device which represents an improvement over presently existing marking pens provided with a fine pen-tip, and more specifically with an ultra-fine pen-tip.

In the Japanese Utility Model Laid-Open No. 54-151438 there is disclosed a marking pen having a pen-tip to be extended out of the pen holder in which the pen-tip is slidably arranged with respect to the holder, and the length of the pen-tip projected from the extreme end of the holder is adjustable at its free position and the pen-tip fixed to the cylinder of ink. The same device as described above in Japanese Utility Model Laid-Open No. 55-10789.

In Japanese Utility Model Laid-Open Nos. 55-5241, 55-5242 and 55-23778 and the product of ZEBRA MILLI GRAPH sold by Zebra Co., Ltd. there is disclosed a stationery device in which pen-tips are slidably arranged with respect to the holder and the pen-tips are fixed to the cylinder of ink.

In Japanese Utility Model Laid-Open No. 55-5268 there is proposed a stationary cylinder in which the holder is axially and movably connected to the cylinder, the pen-tip is slidably provided with respect to the holder above and the pen-tip is fixed to the cylinder of ink.

In Japanese Utility Model Laid-Open No. 49-1031 and the product having the name of Variograph sold by Rotringwerke of West Germany there is proposed a stationary device in which a holder is axially and movably connected to the cylinder, the pen-tip is slidably provided with respect to the holder, the length of the pen-tip projected from the extreme end of the holder is adjustable to any position and the pen-tip is removably attached to the cylinder.

In the Japanese Utility Model Laid-Open Nos. 47-36529 and 57-9579 etc. there is proposed a stationary device in which the holder is axially and movably connected to the cylinder, the pen-tip is slidably arranged with respect to the holder, the length of the pen-tip projected from the extreme end of the holder is adjustable at any position and the pen-tip is fixed to the cylinder of ink.

In the Japanese Utility Model Laid-Open No. 54-179248 there is proposed a sign-pen in which the holder is axially and movably connected to the cylinder, the pen-tip is slidably arranged with respect to the holder, the length of the pen-tip projected from the extreme end of the holder is adjustable to any position and the pen-tip is fixed to the cylinder.

In reference to publication No. 54-151438 for example, the holder is not axially and movably connected to the cylinder and so the pen-tip may not be removed from the stationary. A transmitting part with respect to writing pressure is not formed at the pen-tip and an accepting part to bear the transmitting part is not formed as a part of the cylinder. Therefore, although the axial movement of the holder may provide for relatively easy and positive handling, this device should move the writing means in an axial direction, so that improper threaded engagement between the writing means and the holer or cylinder may cause the writing means not to move smoothly. When the pen-tip is worn out, the cylinder of ink should be entirely replaced and the volume of ink remaining in the cylinder is lost which makes the product uneconomical. Moreover, since the part for writing pressure transmitting and the writing pressure part are not connected, incomplete fixing means of the pen-tip with respect to the cylinder of ink may cause the pen-tip to be pushed into the cylinder by the writing pressure.

Referring to the above prior art reference No. 55-5241, replacement of the pen-tip itself is impossible, so that when the pen-tip is worn out, the pen-tip should be replaced in its entirety and the volume of ink remaining in the cylinder is lost, and thus the replacement of the cylinder may make the unit uneconomical. In this case, since the part transmitting is not connected at the pen-tip and the part for accepting the writing pressure from the transmitting part is not connected at the cylinder of ink, incomplete fixing for the pen-tip with respect to the cylinder may cause the pen-tip to be slick in the cylinder by writing pressure and mechanical shock.

In the device of publication No. 55-5268, the pen-tip is fixed to the cylinder of ink, so that it has the same problems and disadvantages found in the other prior art references.

Referring the the example of the prior art in publication No. 49-1031, this is a device relating to a sign-pen in which synthetic resin fibers are coated and bundled to form a soft and thick pen-tip to obtain the writing touch of a brush. This prior art relates to a device in which the foundational end of the soft and thick pen-tip exhibiting the writing touch of a brush is held by a very light frictional force between the base end and the hole of small diameter of the threaded cylinder. When the coating around the outer circumferential surface of the pen-tip is broken, with the result that most of the ink is consumed by thick writing, a shortage of ink results and so the position of the neck is adjusted in order that the projected length of the pen-tip does not cause breakage of the coating. A proper setting of the projected length of the pen-tip may not necessarily cause the position of the neck part to be varied. However, this is not a device in which the position of the neck is adjusted in order to adjust the projected length of the pen-tip from the neck at any position. If the soft and thick pen-tip may show the writing touch of a brush, the writing pressure during the writing operation may be dispersed at the extreme end of the pen-tip and may not reach the base end of the pen-tip so that the foundational end of the pen-tip is merely held with a light frictional force between it and the hole of small diameter of the threaded cylinder and it may not be thought to be fastened or supported by the small hole. Since the pen-tip is soft and thick, even if its outer circumferential surface is applied with a coating, a threaded engagement of the neck part with the threaded cylinder, the hole of small diameter may cause a local pressing of the neck and thus the neck is partially deformed. This prior art does not disclose the relation in size between an outer diameter of the pen-tip and an inner diameter of a fixing hole and does not provide a restricting means of an axial fixing position of the pen-tip in the small diameter hole of the threaded cylinder. Thus, if the pen-tip has a larger diameter than that of the fixing hole, insertion of the pen-tip into the fixing hole causes the open end of the fixing hole at the threaded neck part to be expanded in an inverted-conical shape, the neck part may not be threadably engaged and, without the restricting means of the fixing position of the latter, the axial fixing position of the pen-tip is varied for each of the products, with the result that the projected length of the pen-tip is different for each of the products.

Thus, if the fine pen-tip including a ultra-fine pen-tip is supported under a technical concept that the pen-tip of soft and thick fibrous material having the writing touch of a brush as found in the prior art is held by a light frictional force against the threaded cylinder of small diameter, the writing pressure applied to the extreme end of the pen-tip reaches to the foundational end of the pen-tip, so that the pen-tip is pushed into the cylinder of ink under the writing pressure, the pen-tip may not be supported and the writing may not be performed and thus only a non-practical, inferior product results. Therefore, with this prior art, it is impossible to provide a firm support for the above-mentioned pen-tip.

Referring to the above publication No. 47-36529, for example, the prior art has problems similar to that of publication No. 55-5241, due to the fixing of the pen-tip to the cylinder of ink.

In the case of the publication No. 54-179248, the pen-tip is fixedly supported in the cylinder, so that when it is worn out, replacement of the pen-tip itself may not be performed and the total product should be deposited wastefully. Since the pen-tip is made to be fixed by caulking of the cylindrical body, the pen-tip is deformed at the caulked point to cause the inner passage of ink to be narrowed and deformed and to hinder the smooth flow of ink.

SUMMARY OF THE INVENTION

Therefore, it is an object of the present device to provide a mechanical marking pen in which the projected length of the pen-tip can be finely adjusted, a replacement of only the pen-tip itself can be performed, the transmitting part of the writing pressure arranged at the pen-tip is engaged with the part for accepting the writing pressure at the cylinder other than the ink guiding core so as not to transmit the writing pressure to the guiding core of the ink and positive writing can be performed without the cylindrical member, although it is preferred to have this member, i.e. the guiding core of ink.

The present invention provides a holder movably arranged axially in a cylinder, a pen-tip being slidably fitted in the holder, the length of the pen-tip projected from the extreme end of the holder capable of being adjusted to any position, a part for transmitting writing pressure arranged at the pen-tip, a part for accepting and supporting the writing pressure transmitting part arranged as a part of the cylinder, other than the guiding core of ink, the transmitting part being engaged with the accepting part, the pen-tip being removably attached to the cylinder.

The device of the present invention is also designed so that adjustment of the position of the holder may cause the projection of the pen-tip to be adjusted to any length, thus the cylinder, not the guiding core of ink, accepts the writing pressure and the pen-tip can be easily removed.

BRIEF DESCRIPTION OF THE DRAWINGS

The present invention will become more fully understood from the detailed description given hereinbelow and the accompanying drawings which are given by way of illustration only, and are not limitative of the present invention, and wherein:

FIG. 1B being a longitudinal front elevational view showing another embodiment; and FIG. 1C being a longitudinal front elevational view showing still a further embodiment.

FIG. 2B being a longitudinal front elevational view showing another embodiment; and FIG. 2C is a longitudinal front elevational view showing still a further embodiment.

FIG. 3C is a longitudinal front elevational view for showing still a further embodiment; FIG. 3E is a cross sectional view taken along a line IIIE—IIIE of FIG. 3B.

FIG. 4B a longitudinal front elevational view for showing another embodiment; and FIG. 4C a longitudinal front elevational view for showing still a further embodiment.

FIG. 5B being a longitudinal front elevational section of another embodiment; and FIG. 5C being a longitudinal front elevational section of still a further embodiment.

DETAILED DESCRIPTION

Figure 1A:
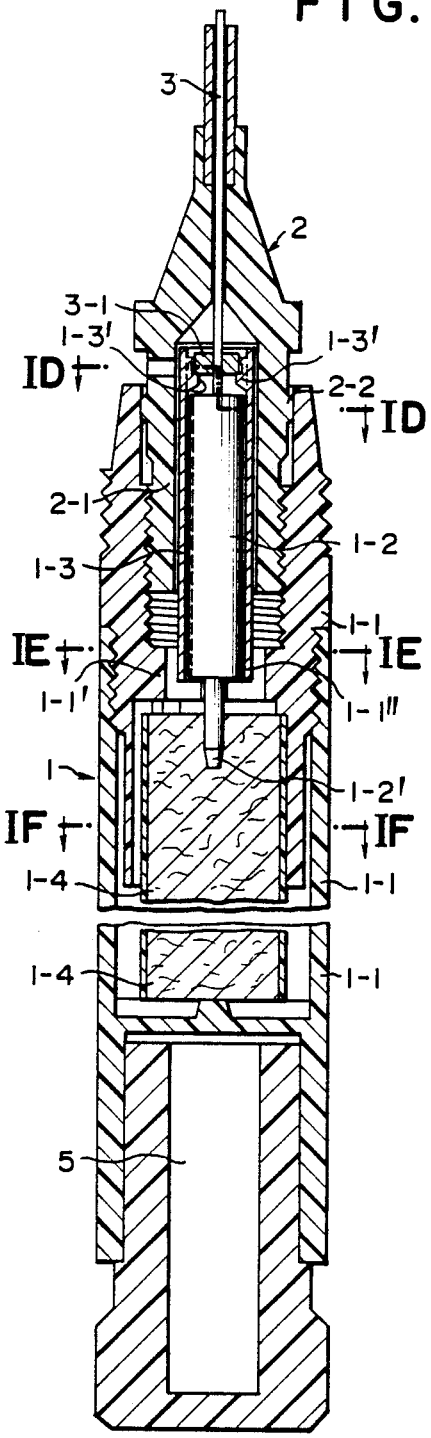
FIGS. 1A to 1C illustrate means for attaching a pen-tip provided with an ink guiding core, with FIG. 1A being a longitudinal front elevational view showing one embodiment.
Figure 1D:
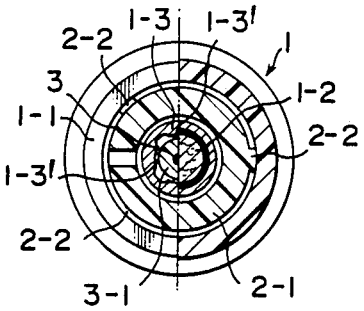
FIG. 1D is a cross sectional view taken along a line ID—ID of FIG. 1A.
Figure 1E:
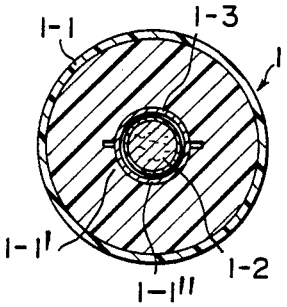
FIG. 1E is a cross sectional view taken along a line IE—IE of FIG. 1A.
Figure 1F:
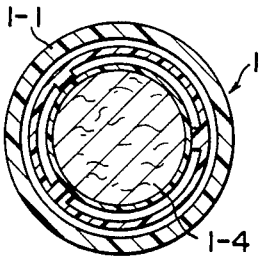
FIG. 1F is a cross sectional view taken along a line IF—IF of FIG. 1A.

Referring now to the drawings, some preferred embodiments of the present device will be described. Like numbers refer to like elements throughout the illustrations. The present device is constructed such that the cylindrical body (1) has a cylinder (1-1), a guiding core of ink (1-2), a part for accepting the writing pressure (1-3) and reservoir of ink (1-4), and apart from these cylindrical forming members, there is arranged a holder (2), pen-tip (3), a cushioning member (4) which can transmit the ink and a case (5) for storing some spare pen-tips.

Figure 1B:
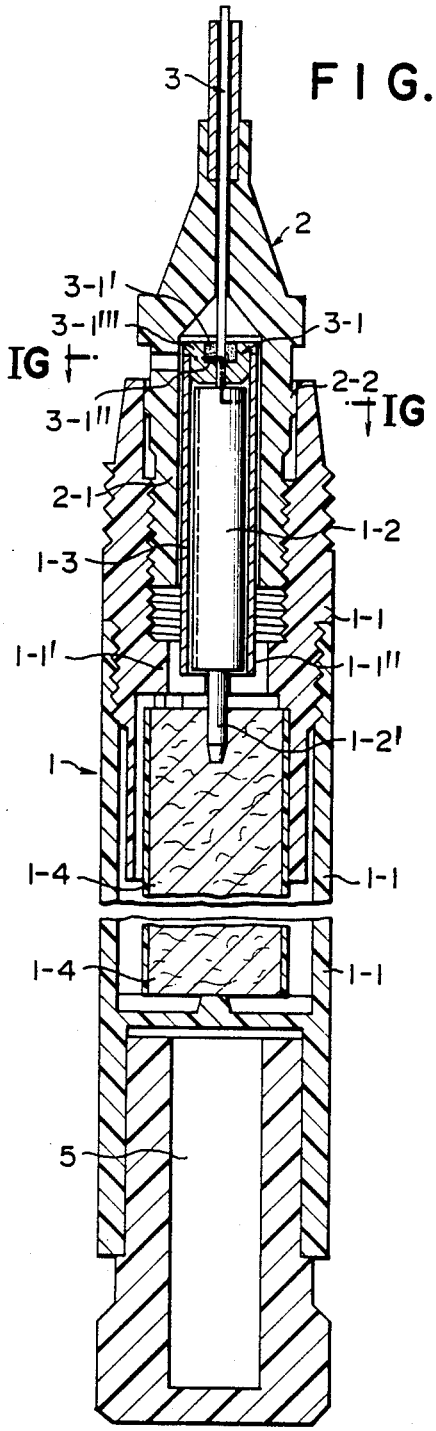
Figure 1G:
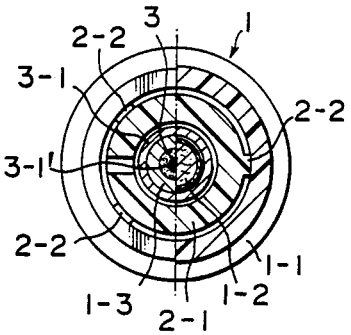
FIG. 1G is a cross sectional view taken along a line IG—IG of FIG. 1E.
Figure 1C:
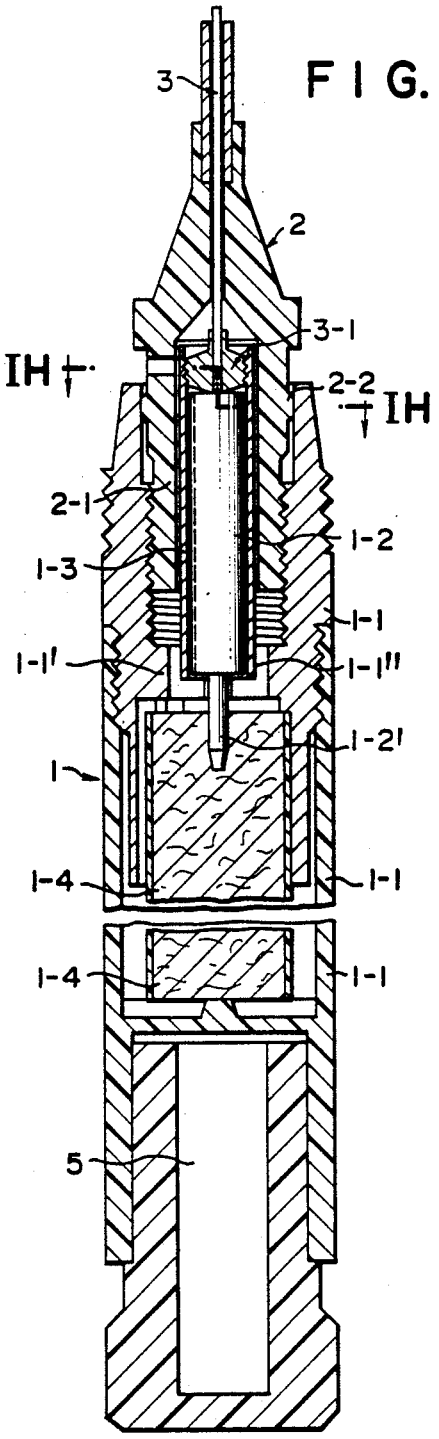
Figure 1H:
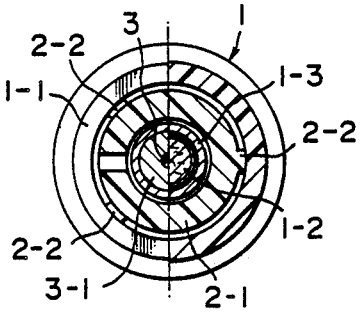
FIG. 1H is a cross sectional view taken along a line IH—IH of FIG. 1C.

The cylindrical body (1) shown in FIG. 1A as the first embodiment is constructed such that the holder (2) is axially movably engaged with and connected by screw threads to the extreme end of the cylinder (1-1), a part (3-1) for transmitting the writing pressure to the pen-tip (3) is removably engaged with the tubular writing pressure accepting part (1-3) removably inserted into the extreme end of the cylinder (1-1), the pen-tip (3) being inserted through the holder (2) to form a relative slidable movement therebetween and at the same time the projection of the pen-tip (3,) from the holder (2) can be adjusted to any length. Further the holder (2) can be adjusted to any length and the pen-tip (3) is removably attached to the cylindrical body (1). The foundational end of the part (1-3) for accepting writing pressure is removably inserted into the insertion hole (1-1″) of a defined wall (1-1′) projected toward the center in the extreme end of the cylindrical body (1), the part for transmitting the writing pressure (3-1),of the pen-tip (3) is removably engaged with the extreme end of the writing pressure accepting part (1-3), the pen-tip (3) is removably attached to the cylindrical part (1) and at the same time the writing pressure is applied to the extreme part (1-3). The accepting part (1-3) in the cylindrical body (1) is made of metal or synthetic resin and is made as a fine tube and at the same, time, as shown in FIG. 1, an engaging stepped part (1-3′) is removably engaged with the engaging stepped part to accept the writing pressure applied to the extreme end of the pen-tip (3) with the engaging stepped part (1-3′). The accepting part (1-3) is constructed such that the inner diameter of the upper part above the step (1-3′) has a smaller diameter capable of press fitting the transmitting part (3-1). Press fitting of this transmitting part prevents the pen-tip (3) from dropping off the accepting part (1-3), even if the cylindrical body (1) is turned upside down. The engaging stepped part (1-3′) of the accepting part (1-3) is formed by an inwardly directed annular projection or more than three inwardly directed projections, and the above-mentioned part having a smaller diameter for press fitting the transmitting part (3-1) is also formed by an inwardly directed annular projection or more than three or an appropriate number of inwardly directed projections. Another example of the above mentioned accepting part (1-3) has the same material quality and fine tube construction as that of the embodiment shown in FIG. 1A. As shown in FIG. 1B, no projection is made at the inner part of the extreme end, and the transmitting part (3-1) is press fitted to the accepting part (1-3) and at the same time pressed to the end surface of the holder (2). Even if the cylindrical body (1) is turned upside down the transmitting part (3-1) will not fall off the accepting part (1-3). Further the writing pressure applied to the tip of the pen-tip (3) is accepted by the writing pressure accepting part (1-3) and is the same as that shown in FIG. 1A in its material and structure of the fine tube. The transmitting part (3-1) is engaged by screw threads with the extreme end of the accepting part as shown in FIG. 1C. As apparent from these preferred embodiments, the transmitting part (3-1) of the pen-tip (3) is removably installed with respect to the accepting art (1-3) and therefore the pen-tip (3) is removably attached to the cylindrical body (1). The guiding core (1-2) of ink of the cylindrical body (1) can be made of a fibrous body or molded synthetic resin, a sintered body of metallic particles or particles of synthetic resin, as shown in FIG. 1A and in all cases, it is formed of a rod-like body, with a transmitting wick (1-2) having a small diameter projected at the end part of the reservoir of ink, the transmitting wick of ink being pushed into the reservoir (1-4) so as to cause the ink to be transmitted to the pen-tip (3).

The holder (2) shown in FIG. 1A is constructed such that the connecting section (2-1) is engaged by screw threads with the extreme end of the cylinder (1-1) of the cylindrical body (1), axially, movably connected thereto. The projection of the pen-tip (3) may be adjusted to any length while at the same time the oversized cylindrical ring (2-2) surrounding the outer cylindrical surface of the neck of the connecting part (2-1) is fitted closely to the inner cylindrical surface of the extreme end of the cylinder (1-1) to prevent the holder (2) from shaking during writing. The structure with projection (202) of the holder (2) is formed of an oversized cylindrical ring of at least three or more appropriate number of outwardly directed projections.

The pen-tip (3) shown in FIG. 1A is of a fine solid wick, less than 1 mm in diameter, of synthetic resin or a fibrous fine solid wick. A pressure transmitting part (3-1) is integrally arranged at the foundation end or otherwise intermediate position of the pen-tip in which the pen-tip is inserted and pressure fitted. The pressure transmitting part (3-1) may be made of a metal of a synthetic resin as shown in FIG. 1A. FIG. 1B shows an example in which the pen-tip (3) is press fitted and inserted through the transmitting part (3-1) with an adhesive agent (3-1) being applied to the writing pressure transmitting part. FIG. 1C shows an example in which the pen-tip is press fitted in a similar manner as that shown in FIG. 1A. In FIG. 1A is shown an example in which the pressure transmitting part (3-1) of the pen-tip (3) is arranged such that the molded body formed separately from the pen-tip (3) is installed around the pen-tip (3) like a flange and engaged with the engaging stepped part (1-3′) of the pressure accepting part (1-3). FIG. 1B shows an example in which an adhesive agent (3-1′) is applied to an indentation (3-1″) formed at the central part of the molded body formed to an inverted hat-shape in sectional form FIG. 1G so as to make an integral assembly of the pen-tip (3) and at the same time the engaging edge (3-1″) made around the circumferential edge of the indentation. FIG. 1C shows an example in which the outer cylindrical surface of the transmitting part (3-1), to which the pen-tip (3) is press fitted and fixed, is threaded and engages threads on the inner cylindrical surface of the extreme end of the accepting part (1-3), and in both cases, the pen-tip (3) is connected to the guiding core (1-2).

If the pen-tip (3) is removably attached to a part of the cylindrical body (1) as described above, that is, to the writing pressure accepting part (1-3), the writing pressure applied to the extreme end of the pen-tip (3) from any direction is distributed to be accepted by the cylinder (1) excluding the guiding core (1-2), i.e. the pressure is transmitted to the pressure accepting part (1-3) and then transmitted to the cylinder (1-1), so that the pen-tip (3) is stable and the ink in the ink reservoir (1-4) is positively fed to the pen-tip (3) and positive and clear writing can be expected. Furthermore, if the holder (2) is removed from the cylinder (1-1) an easy replacement of the pen-tip is possible.

Figure 2A:
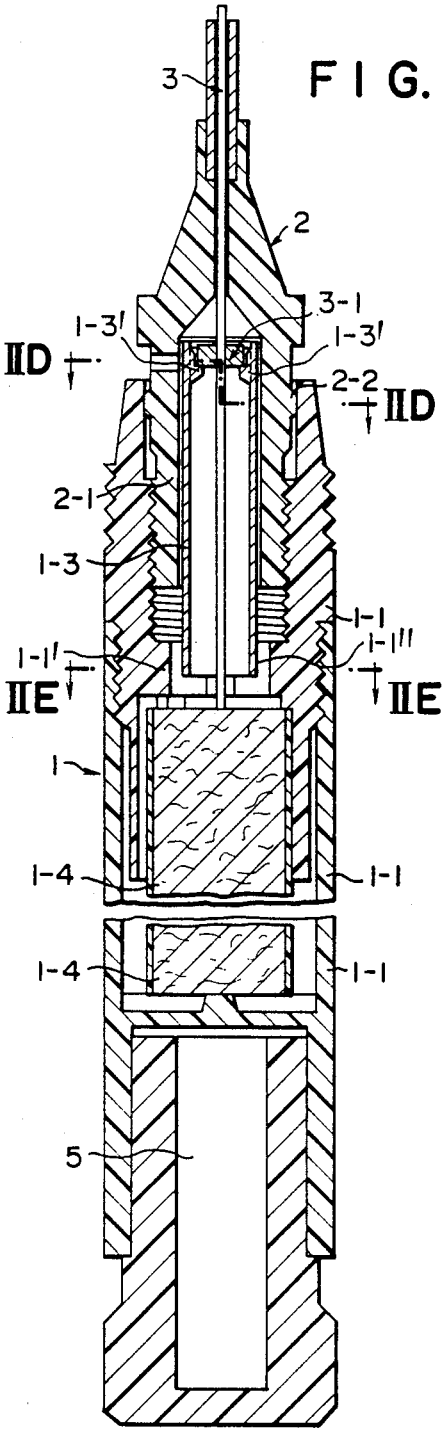
FIGS. 2A to 2C illustrate an example of pen-tip attaching means, with FIG. 2A being a longitudinal front elevational view showing one embodiment.
Figure 2D:
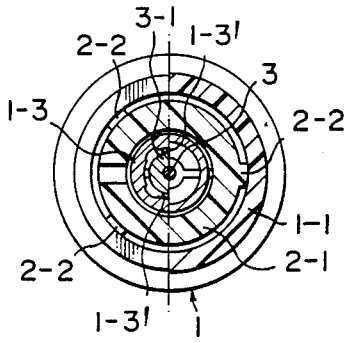
FIG. 2D is a cross sectional view taken along a line IID—IID of FIG. 2A.
Figure 2E:
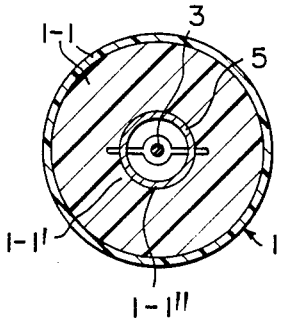
FIG. 2E is a cross sectional view taken along a line IIE—IIE of FIG. 2A.
Figure 2B:
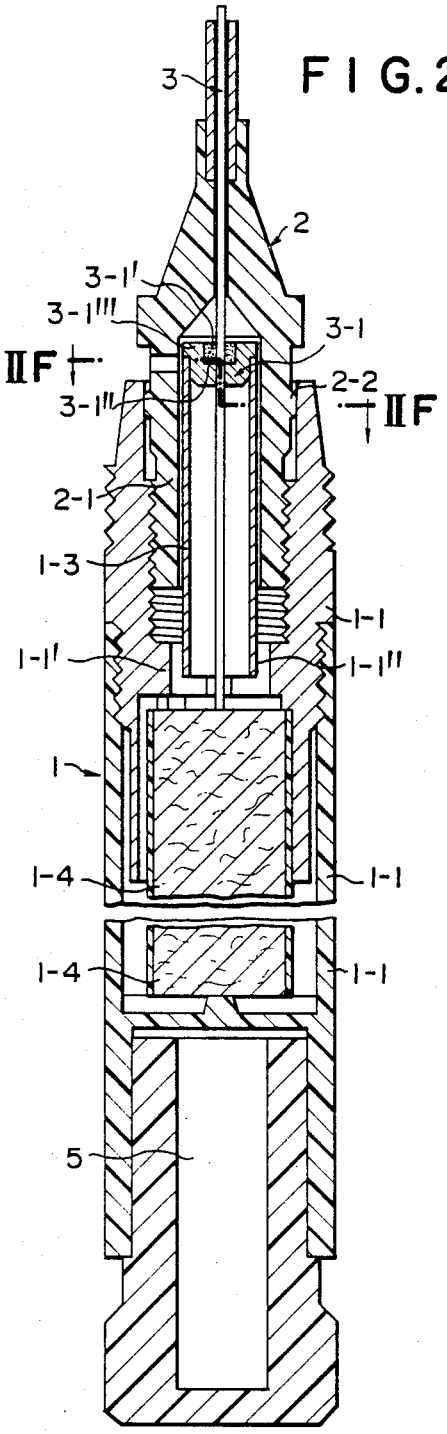
Figure 2F:
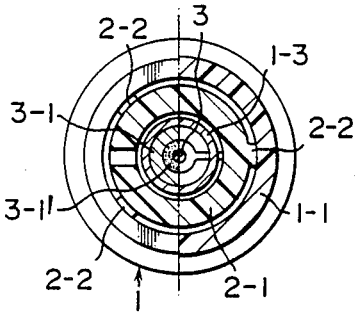
FIG. 2F is a cross sectional view taken along a line IIG—IIG of FIG. 2C.
Figure 2C:
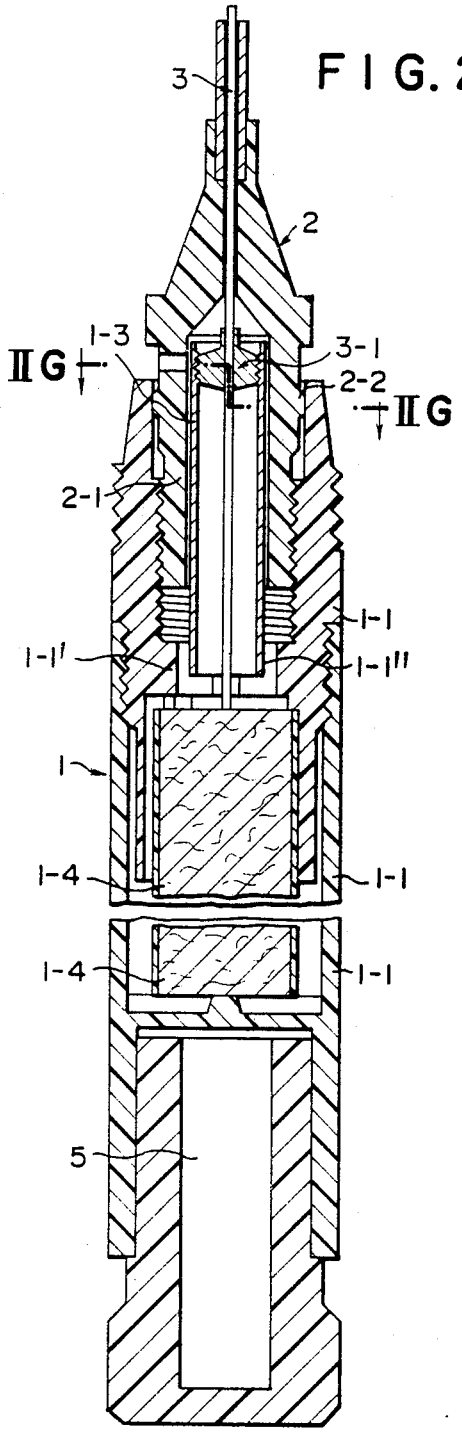
Figure 2G:
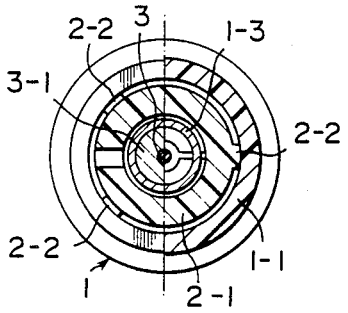
Figure 3A:
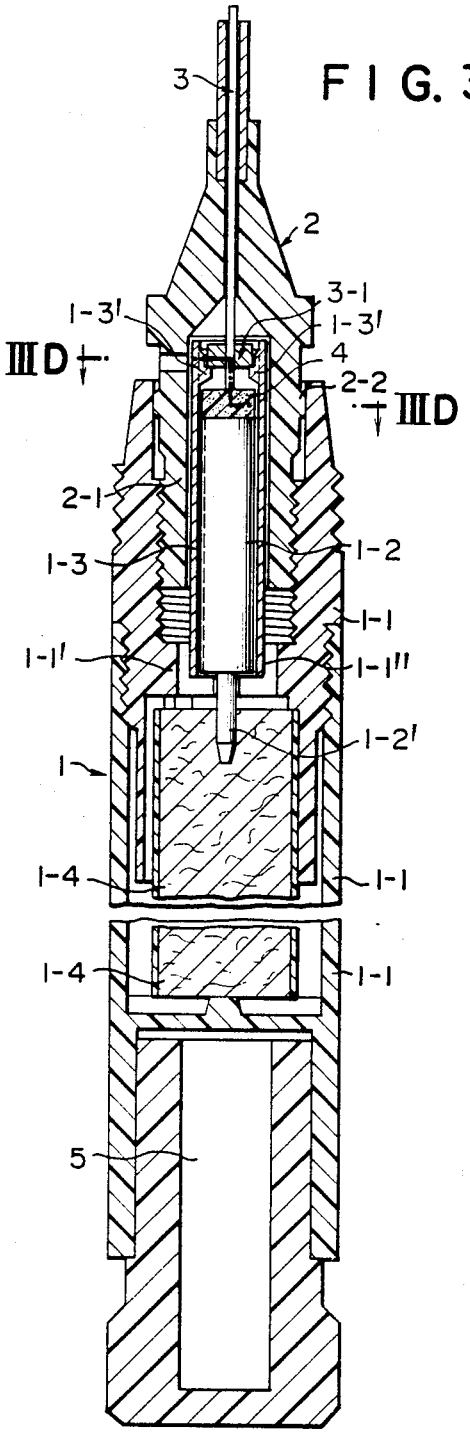
FIGS. 3A to 3C illustrate an example of means for attaching a pen-tip where a cushioning member is provided in the preferred embodiment shown in FIG. 1; with FIG. 3A being a longitudinal front elevational view for showing one embodiment.
Figure 3D:
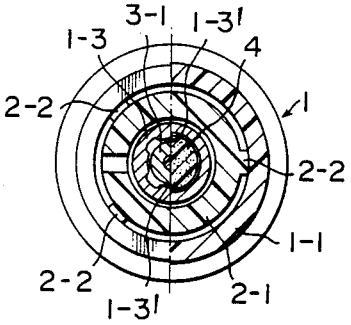
FIG. 3D is a cross sectional view taken along a line IIID—IIID of FIG. 3A.
Figure 3B:
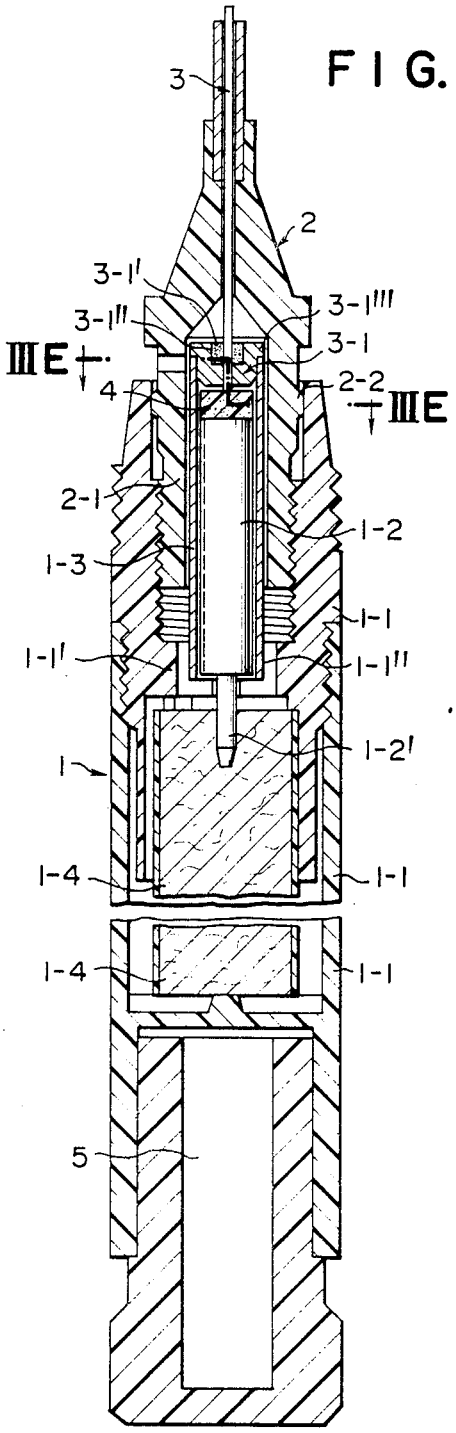
Figure 3E:
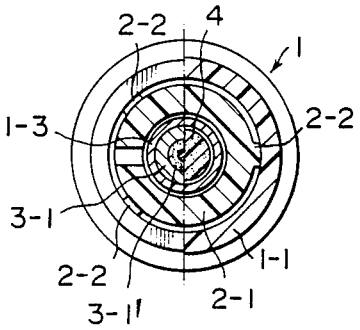
FIG. 3E is a longitudinal front elevational view for showing another embodiment.
Figure 3C:
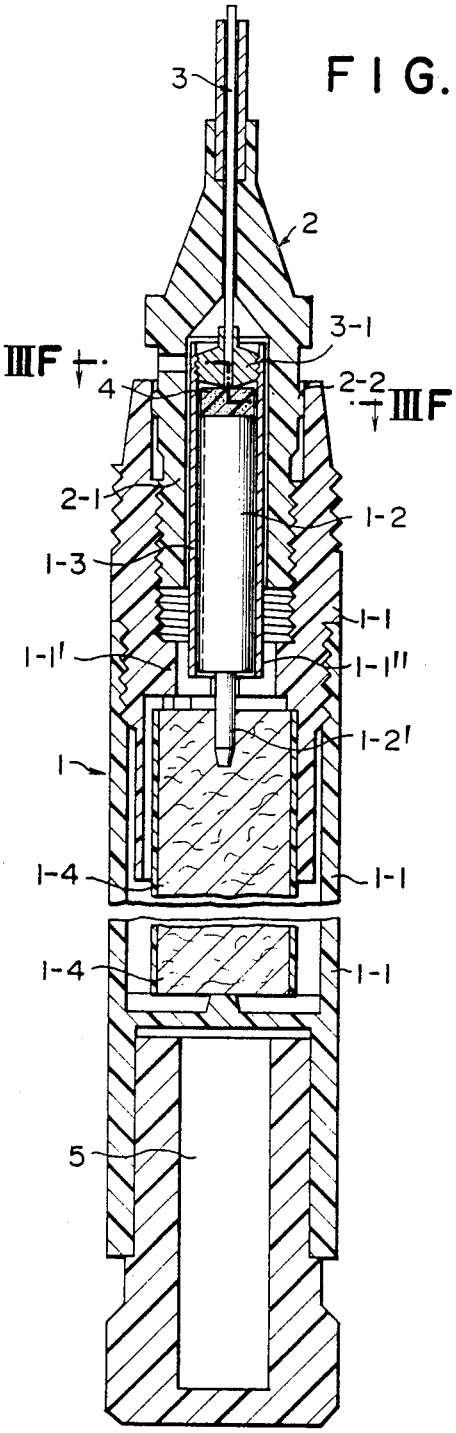
Figure 3F:
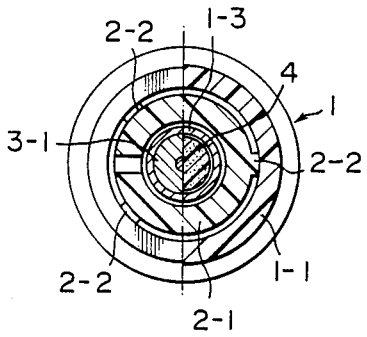
FIG. 3F is a cross sectional view taken along a line IIIF—IIIF of FIG. 3C.
Figure 4A:
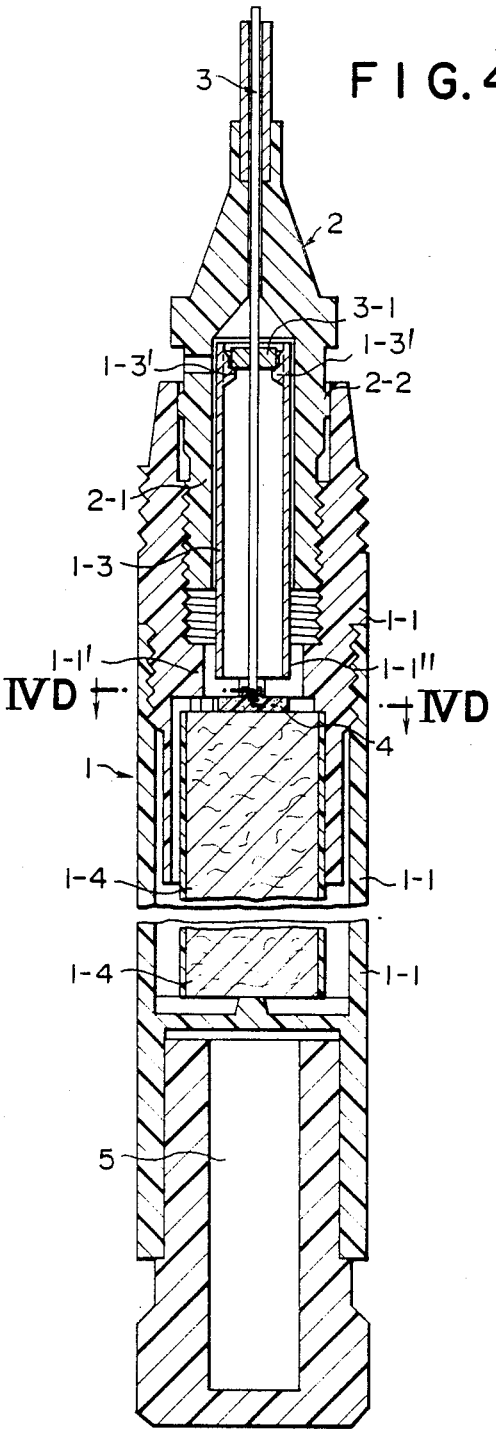
FIGS. 4A to 4C illustrate an example of means for attaching the pen-tip in the case where a cushioning member is provided in the preferred embodiment shown in FIG. 2, with FIG. 4A being a longitudinal front elevational view for showing one embodiment.
Figure 4D:
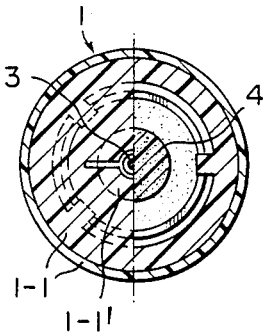
FIG. 4D is a cross sectional view taken along a line IVE—IVE of FIG. 4B.
Figure 4B:
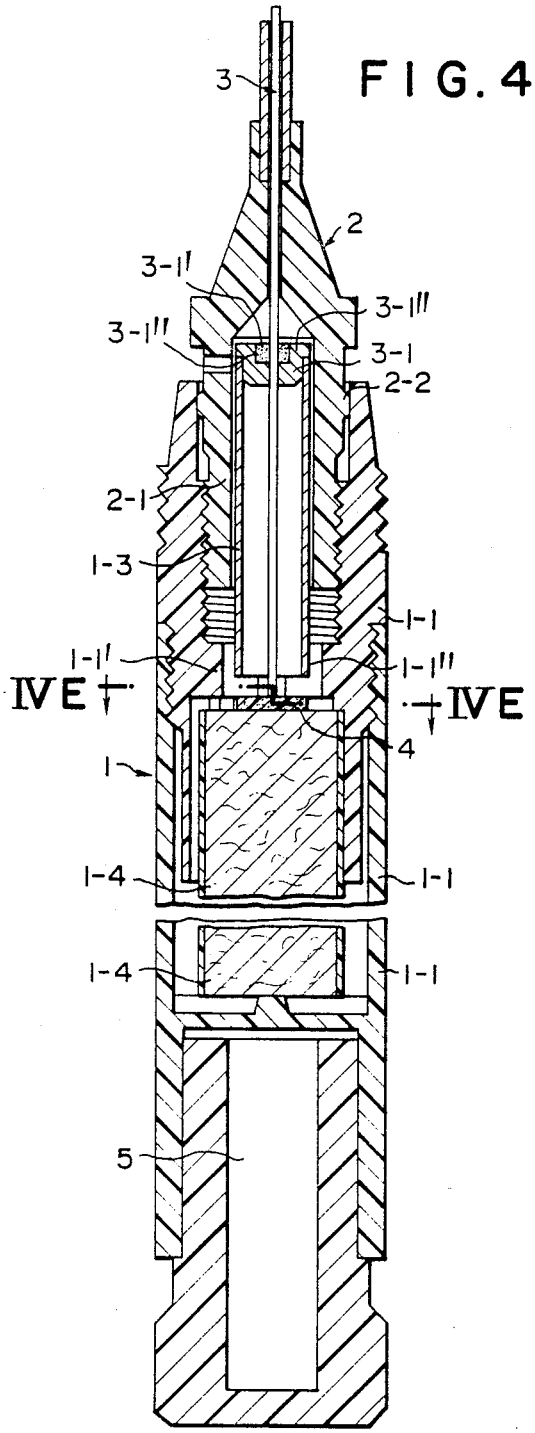
Figure 4E:
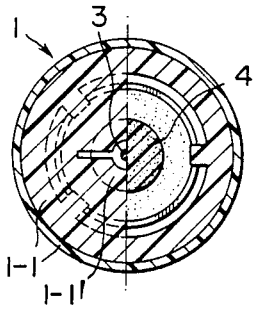
Figure 4C:
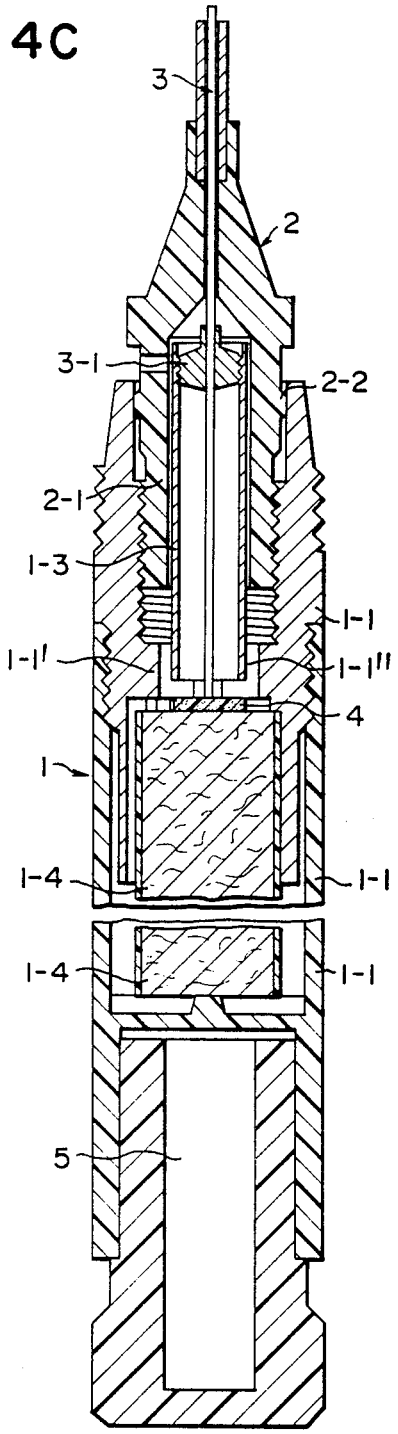

The embodiment shown in FIG. 2A, as a second example, differs from the cylindrical body (1) of the first example in that the structure does not have a guide core (1-2). Thus, the pen-tip (3) shown in FIG. 2A is made long, its appropriate intermediate part being fixed to the pressure transmitting part (3-1), and its foundation end is directly connected to the reservoir (1-4) of ink. The writing pressure is transmitted from the pen-tip (3) to the pressure accepting part (1-3) in sequence, providing a stable attached condition for the pen-tip (3).

FIGS. 3A-F and 4A-E illustrate examples in which there is arranged a cushioning member (4) capable of feeding ink, placed between a part of the cylinder (1), i.e. the ink guide core (1-2), and the pen-tip (3). The purpose for the cushioning member (4) to be so arranged resides in the fact that even if the length of each of the members directly or indirectly related to transmission of ink, such as the ink guide core (1-2), the writing pressure accepting part (1-3), the pen-tip (3) and writing pressure transmitting part (3-1) show an error in size, disadvantages such as poor feeding of ink caused by the error in size can be eliminated. The cushioning member (4) is preferably of material having a resilient property as well as capable of feeding ink, for example, it may be made of a tablet-shaped body of porous resilient rubber of synthetic resin tablet-shaped body having fibers wound to a proper solidity with a liquid synthetic resin. Arrangement of the cushioning member between the ink guide core (1-2) and the pen-tip (3) causes the ink to flow from the reservoir (1-4), via the guide core (1-2), and cushioning member (4) to the pen-tip (3) in sequence, resulting in execution of the writing operation.

The preferred embodiment shown in FIG. 4(A-E) is a structure in which the above-mentioned cushioning member (4) is added to the embodiment shown in FIG. 2, and practically it is a structure in which the above cushion member (4) is arranged between a part of the cylinder (1), i.e. the ink reservoir (1-4) of ink and the pen-tip (3). With this arrangement, the ink is fed from the ink reservoir (1-4) via the cushioning member (4) to the pen-tip (3), in sequence, to enable the writing operation to be performed. Material of the cushioning member (4) in this example may be the same as described above.

The writing pressure in the preferred embodiment shown in FIGS. 3 and 4 is transferred to the cylinder (1) in the same manner as that shown in FIG. 1.

The presence of the cushion member (4) may eliminate any poor connection of each of the members, such as the guide core (1-2), reservoir (1-4) of ink and pen-tip (3) even if some errors in the length of the above-mentioned members relating to the feeding of ink are made, and thus it may eliminate poor feeding of ink.

The preferred embodiment shown in FIG. 5 (A-F) shows some examples of the structure of pen-tip (3), wherein the ink guide core (1-2) is provided. The pen-tip (3) may be constructed as shown in FIG. 5A in which the writing pressure transmitting part is near the foundation end of the pen-tip. As shown in FIG. 5B, the pen-tip (3) may be passed through the separate pressure transmitting part (3-1) and at the same time may be integrally formed with the adhesive agent (3-1) being engaged with the extreme end surface of the pressure accepting part (1-3) and also fixed to the extreme end of the pressure accepting part (1-3) with an adhesive agent.

The preferred embodiment shown in FIG. C provides the pen-tip (3) with a restricting part (3-2) to restrict an axial fixing position of the pen-tip (3) with respect to the pressure transmitting part (3-1) when the pen-tip (3) is passed through the pressure transmitting part (3-1). Therefore, the pen-tip (3) is passed only a predetermined distance with respect to the pressure transmitting part (3-1) due to the presence of the restriction (3-2). The pen-tip and the writing pressure transmitting part (3-1) and the writing pressure accepting part (1-3) are integrally connected by an adhesive agent (3-1').

Figure 5A:
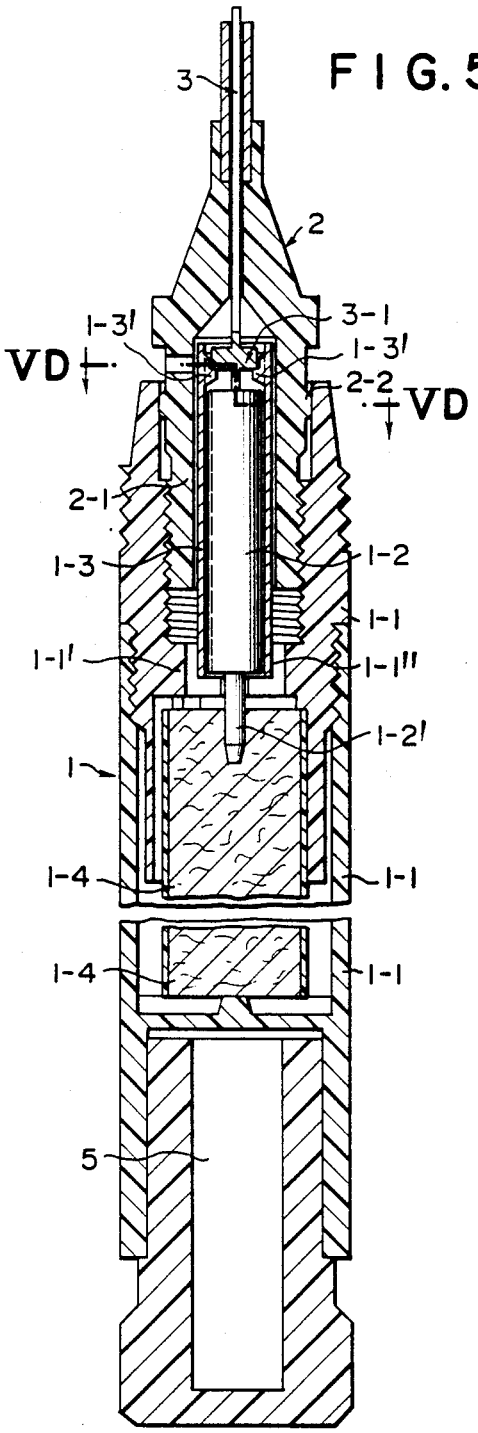
FIGS. 5A to 5C illustrate an example of a means for attaching the pen-tip in which the structure of the pen-tip is modified, with FIG. 5A being a longitudinal front elevational section of a first embodiment.
Figure 5D:
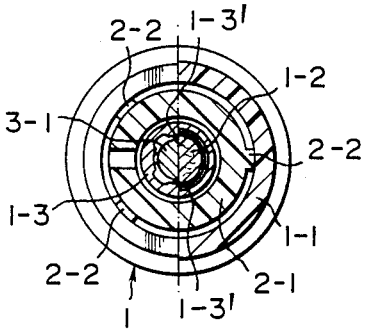
FIG. 5D is a cross sectional view taken along a line VD—VD of FIG. 5A.
Figure 5B:
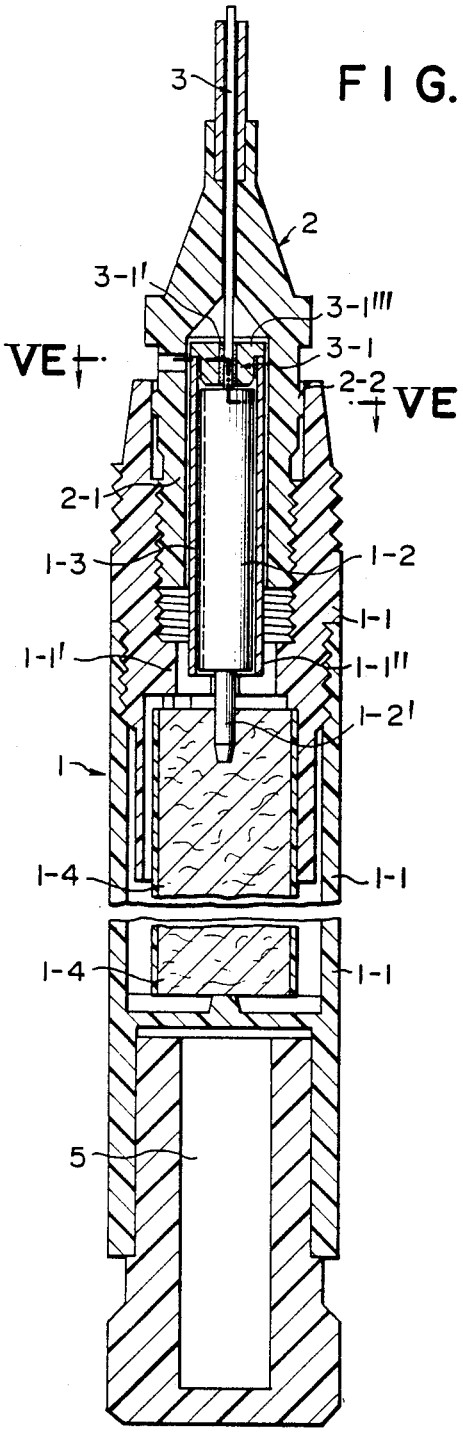
Figure 5E:
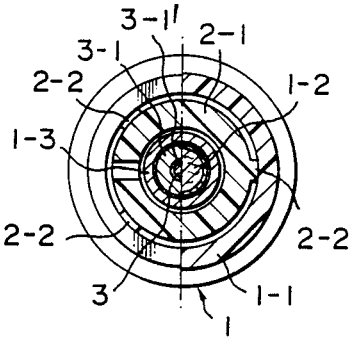
FIG. 5E is a cross sectional view taken along a line VE—VE of FIG. 5B.
Figure 5C:
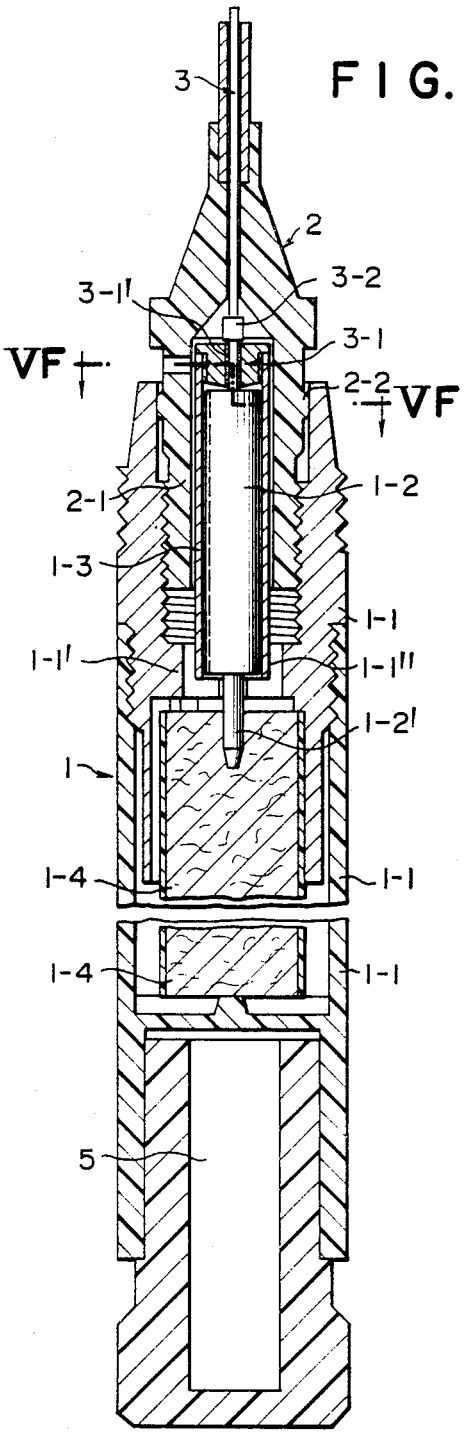
Figure 5F:
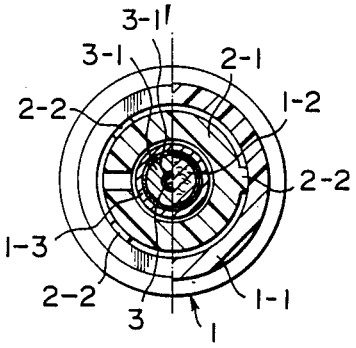
FIG. 5F is a cross sectional view taken along a line VF—VF of FIG. 5C.

Since the preferred embodiment shown in FIG. 5 is constructed as above, in FIG. 5A, the pen-tip (3) and the pressure transmitting part (3-1) can be removed from the cylinder (1), i.e. the writing pressure accepting part (1-3), and in the case of the units shown in FIG. 5B and FIG. 5C, the pen-tip (3) and the writing pressure transmitting part (3-1) can be removed and in both cases, the pen-tip (3) may be replaced.

The reservoir of ink (1-4) in all these preferred embodiments is properly selected from an ink storing body immersed with ink or a cylinder storing ink and the illustrated example represents only only one in which the storing body of ink is applied.

Since the present device is constructed such that the writing pressure transmitting part is related to the pen-tip as described above, the writing pressure accepting part supports the writing pressure transmitting part and is arranged as a part of the cylinder. The ink guide core therefore does not support the writing pressure transmitting part. The pen-tip is thus removably attached to the cylinder. If no ink guide core is provided, the pen-tip may still be attached in a stable manner to cause the feeding of ink while at the same time the pen-tip may always be replaced with a new one. This unit is more economical than that of the prior art.

The invention being thus described, it will obvious that the same may be varied in many ways. Such variations are not to be regarded as a departure from the spirit and scope of the invention, and all such modifications as would be obvious to one skilled in the art are intended to be included within the scope of the following claims.

We claim:

1. A mechanical marking pen comprising:

a cylinder;

holder means axially and movably engaged with one end of said cylinder;

ink reservoir means contained in said cylinder for storing ink;

a pen point removably attached to said cylinder and slidably fitted co-centric in said holder means, one end of said pen point projecting from said holder means for permitting a length of projection to be adjusted, and the other end of said pen point connected to said ink reservoir means;

means, co-centric with said pen point, for receiving and transmitting writing pressure from said pen point; and means, co-centric with said pen point and engaged with said transmitting means, for accepting said writing pressure from said receiving and transmitting means, wherein said accepting means is tubular shaped and wherein said receiving and transmitting means is U-shaped and press fitted to said accepting means and to said holder means.

2. A mechanical marking pen, comprising:

a cylinder;

a holder means axially and movably engaged with one end of said cylinder;

a pen point removably attached to said cylinder and slidably fitted cocentrically in said holder means and projecting therefrom of permitting a length of projection to be adjusted;

an ink reservoir means contained in said cylinder for storing ink;

an ink guide core for connecting said pen point and said ink reservoir means to permit transfer of ink to said pen point;

means, cocentric with said pen point, for receiving and transferring writing pressure from said pen point; and means, cocentric with said pen point and engaged with said receiving and transferring means, for accepting said writing pressure from said transferring means so as to prevent said ink guide core from receiving writing pressure from said pen point.

3. The mechanical marking pen of claim 2, wherein said cylinder and holder means are engaged by screw threads.

4. The mechanical marking pen of claim 2, wherein said means for accepting said pen point pressure is constructed of metal or synthetic resin.

5. The mechanical marking pen of claim 2, wherein said accepting means is tubular shaped, surrounding said ink guide core, and has a stepped portion at an area of engagement with said receiving and transferring means.

6. The mechanical marking pen of claim 5, wherein said accepting means has a smaller diameter above said stepped portion for cocentrically press fitting said receiving and transmitting means.

7. The mechanical marking pen of claim 5, wherein said stepped portion is formed by at least one inwardly directed annular projection.

8. The mechanical marking pen of claim 2, wherein said receiving and transmitting means is press fitted to said accepting means and to said holder means.

9. The mechanical marking pen of claim 2, wherein said ink guide core includes an ink transmitting wick having a portion thereof projected into said ink reservoir means.

10. The mechanical marking pen of claim 2, wherein said pen point is a solid wick constructed of a synthetic resin or fibrous material.

11. The mechanical marking pen of claim 8, wherein said receiving and transmitting means is U-shaped.

12. The mechanical marking pen of claim 11, wherein an adhesive agent is filled in said receiving and transmitting means.

13. The mechanical marking pen of claim 2, wherein said receiving and transmitting means is threadably and cocentrically engaged with said accepting means.

14. The mechanical marking pen of claim 2, which further comprises a cushioning means, capable of feeding ink and located between said pen point and ink guide core, for permitting ink to flow, in sequence, from said reservoir means to said guide core, to said cushioning means, and to said pen point.

15. The mechanical marking pen of claim 12, which further comprises a cushioning means, capable of feeding ink and located between said pen point and ink guide core, for permitting ink to flow, in sequence, from said reservoir means to said guide core, to said cushioning means, and to said pen point.

16. The mechanical marking pen of claim 13, which further comprises a cushioning means, capable of feeding ink, and located between said pen point and ink guide core, for permitting ink to flow, in sequence, from said reservoir means to said guide core, to said cushioning means, and to said pen point.

17. The mechanical marking pen of claim 2, which further comprises means, cocentric with said pen point, to restrict the axial position of said pen point with respect to said receiving and transmitting means.

18. The mechanical marking pen of claim 17, wherein said receiving and transmitting means, accepting means, and said pen point are integrally connected by an adhesive agent.

* * * * *